US005612517A

United States Patent [19]

Johansson

[11] Patent Number: 5,612,517

[45] Date of Patent: Mar. 18, 1997

[54] PROCESS AND APPARATUS FOR CONTROLLING A HYDRAULIC LIFT

[75] Inventor: Kjell Johansson, Ingelstad, Sweden

[73] Assignee: Inventio AG, Hergiswil, Switzerland

[21] Appl. No.: 290,284

[22] Filed: Aug. 15, 1994

[30] Foreign Application Priority Data

Sep. 15, 1993 [EP] European Pat. Off. ..... 93114800

[51] Int. Cl.[6] ..... B66B 1/26

[52] U.S. Cl. ..... 187/285; 187/295

[58] Field of Search ..... 187/285, 286, 187/293, 294, 295

[56] References Cited

U.S. PATENT DOCUMENTS

| | | | |
|---|---|---|---|
| 4,527,662 | 7/1985 | Doane et al. | 187/29 R |
| 4,715,478 | 12/1987 | Nakamura et al. | 187/111 |
| 4,976,338 | 12/1990 | Holland | 187/110 |
| 5,040,639 | 8/1991 | Watanabe et al. | 187/111 |
| 5,099,957 | 3/1992 | Eriksson | 187/111 |
| 5,266,756 | 11/1993 | Hatano | 187/111 |

FOREIGN PATENT DOCUMENTS

| | | | |
|---|---|---|---|
| 3638247 | 5/1987 | Germany . | |
| 4-75981 | 3/1992 | Japan | 187/285 |
| 4-106082 | 4/1992 | Japan | 187/285 |
| 2243229 | 10/1991 | United Kingdom . | |

*Primary Examiner*—Robert Nappi

*Attorney, Agent, or Firm*—Greenblum & Bernstein P.L.C.

[57] ABSTRACT

Process and apparatus for controlling a hydraulic lift wherein with this process, a direct approach to a floor can be achieved without requiring a creeping velocity drive, whereby the car is controlled in a position-dependent manner during the deceleration phase, for the purpose of which a control region is formed which is subdivided into percentage values, the percentage values being retained in tabular form with reference to measured actual position values and upon input of a specific actual position value, the corresponding percentage value is multiplied with the value of the control region (CS) and to this product eventually are added a control deviation (CO) and a pilot control signal (SO) wherein the sum which constitutes the actual control signal used during the deceleration phase, is forwarded to a regulation valve arrangement. An apparatus for carrying out the process is also set forth.

12 Claims, 3 Drawing Sheets

PROCESS AND APPARATUS FOR CONTROLLING A HYDRAULIC LIFT

CROSS REFERENCE TO RELATED APPLICATIONS

This application claims the priority of European Patent Application No. 93 114800.1, filed 15 Sep. 1993.

BACKGROUND OF THE INVENTION

1. Field of the Invention

This invention pertains to a process and an apparatus for the control of a hydraulic lift wherein a control device produces control signals that are directed to a regulation valve arrangement which in turn so controls the through-flow of fluid under pressure that an elevator car is accelerated, moves with a constant velocity and thereafter decelerates upon the arrival of a shaft information signal which in turn produces a brake-input or slow down initiation point.

2. Discussion of the Background of the Invention and Material Information

In such lifts, the drive Velocity depends more or less strongly on variations in car load and the temperature of the hydraulic pressure medium, whereby the hydraulic pressure flow, controlled via a regulation valve, changes correspondingly so that an exact floor approach is not possible. In order to correct this deficiency, shortly prior to the arrival at the floor, the velocity is switched to a small, constant creeping or levelling speed, so that the height difference, caused via load and/or temperature changes, can be compensated (see prior art FIG. 3). This, in turn, leads to increasing operating and waiting times for users and requires high energy usage in hydraulic lifts, in addition and as is well known, the length of the creeping speed is also dependent upon load and temperature conditions.

German Patent Publication DE 36 38 247 teaches an apparatus for a hydraulic lift according to which the previously noted deficiencies are to be eliminated. This apparatus utilizes a control device that produces output signals defined by the velocity behavior of the lift, with these output signals then being directed to a control valve. The control valve, in turn, channels pressurized fluid, from a source of fluid pressure, to or from a hydraulic drive cylinder, in accordance with these output signals. In a memory unit, connected with the control device via a computer, reference velocity values are stored, which values correspond with defined operating condition, which in turn are based upon differing load and/or temperature relationships. A sensing element attached to the car obtains the actual velocity and channels same, via a converter system, to the computer. Therewith, a difference is obtained between the actual velocity, measured during the acceleration phase, and a predetermined reference speed, based upon which the computer calculates a control velocity curve. This curve, in turn, is stored and then utilized during the deceleration phase to correct the actual velocity to, the value of the previously-mentioned reference velocity. In this manner, an exact and quick approach to designated areas is to be achieved and the operating time of the lift is to be reduced. However, this control device, even though not utilizing a control circuit or control for the adaptation of the slow down initiation point, cannot operate without the use of a creeping or levelling speed.

SUMMARY OF THE INVENTION

The task or object of this invention pertains to a process, and an apparatus for practicing the process for controlling a hydraulic lift so as to permit a direct floor approach without requiring a creeping speed.

One embodiment of this invention pertains to a process for controlling a hydraulic lift having a control device, with control signals (S) produced via the aid of a sensing element in combination with a car of the lift, wherein these signals (S) are directed to a regulation valve arrangement, with the regulation valve arrangement so regulating the through-flow of pressurized fluid that the car is accelerated upwardly or downwardly, is moved at an operational speed and is decelerated upon the input of a slow down point, signalled via a shaft information, the process comprising: receiving position signals in the sensing element and controlling the car in a position-dependent manner during the deceleration phase wherein, upon the inputting of a drive command, determining and storing a first value (S1) of the control signal (S), at the start time of the car; storing a second value (S2) of the control signal (S) of the control device upon the inputting of a slow down signal; constituting a control region (CS), based on the relationship CS=S2–S1+H, wherein S1 is the first value of the control signal, S2 is the second value of the control signal and H is a previously determined hysteresis value; producing, during the deceleration phase, actual values (si) from the position signals; allocating a percentage value (%S) of the control region (CS;) to each actual value (si); multiplying the percentage values (%S) with the values of the control region (CS); and determining, with the thus achieved product, the extent of the control signal (S) utilized during the deceleration phase.

In a further embodiment of the process of this invention a signal, reproducing the location of a main valve piston, obtained via a spring coupled to a piston rod, serves as a feedback signal.

Another embodiment of the process of this invention further includes adding to a product designated as the control signal, a control deviation (CO) and a pilot control signal (SO), wherein CO is determined via the relationship CO=S2–SO–CS, and wherein S2 is the second value of the control signal, SO is the pilot control signal and CS is the control region, with the thus ascertained sum representing the control signal (S), that is utilized during the deceleration phase.

An additional embodiment of the process of this invention further includes determining a hysteresis value (H) during a learning trip, whereby the control signal (S) is increased until the velocity achieves a predetermined value, wherein, upon reaching the predetermined value, measuring and storing the strength of the control signal (S), thereafter increasing the control signal (S) and after a while again decreasing the control signal, until again reaching the predetermined value of the velocity, again measuring the strength of the control signal (S), with the difference between the two measured values being the hysteresis value (H).

Still a further embodiment of the process of this invention further includes determining the pilot control signal (SO) during a learning trip, wherein a spool of the regulation valve arrangement is impacted with an increasing stepped control signal (S) until the car moves and wherein the thus obtained control signal is reduced by a constant value and stored as a pilot control signal (SO).

Yet another embodiment of the process of this invention further includes determining a boundary control signal (SL) during a learning trip, whereby a spool of the regulation valve arrangement is impacted with an increasing, stepped control signal (S) until the velocity of the car no longer increases.

A different embodiment of the process of this invention further includes the car proceeding in an unregulated manner in the phase before the deceleration phase whereby the velocity, in the ascending direction, is limited by the configuration of at least one of the hydraulic components of the hydraulic lift.

An additional embodiment of this invention pertains to an apparatus for carrying out the process of this invention by means of a control device controlling a regulation valve arrangement and with a sensing element in combination with a car, wherein the control device includes at least a tachometer signal transducer, wherein the sensing element is connected to the input of the tachometer signal transducer; wherein the control device also includes a position controller having an input connected with an output of the tachometer signal transducer, with the tachometer signal transducer outputting actual values (si), the position controller having an output connected with the regulation valve arrangement, during the deceleration phase; the position controller including a table, the table storing allocations of actual values (si) relative to percentage values (%S) of a control region (CS), the position controller including a multiplier, one input of the multiplier being connected with the table while another input of the multiplier is provided with the value of the control region (CS), with the output of the multiplier forming the output of the position controller.

Further embodiments of this invention pertain to an apparatus wherein the regulation valve arrangement includes a stroke-force feedback; wherein the stroke-force feedback is produced via a compression spring; and wherein the control device utilizes a digital position controller.

The advantages achieved by this invention are that the operating and waiting periods are reduced; that the temperature of the fluid pressure medium is heated less and the consumption of energy is reduced. Via the suggested direct floor approach, by the use of a regulation valve arrangement having a simple constructional position feedback system, an exact stop, without a level readjustment, is achieved and, with reference to ride quality and minimal operating time, achieves an optimal deceleration result. At the same time, load and temperature variations will not influence the stopping accuracy. It is also advantageous that the acceleration of the car and the operation, at rated speed, occur without regulation, the latter having a favorable impact upon the efficiency of the hydraulic drive. An additional advantage is in that the use of a regulation valve arrangement, which during its use interacts with a control device, permits the automatic determination of lift-specific parameters during learning or self-teaching trips. Thus, manual adjustments during the initial installation can be avoided.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
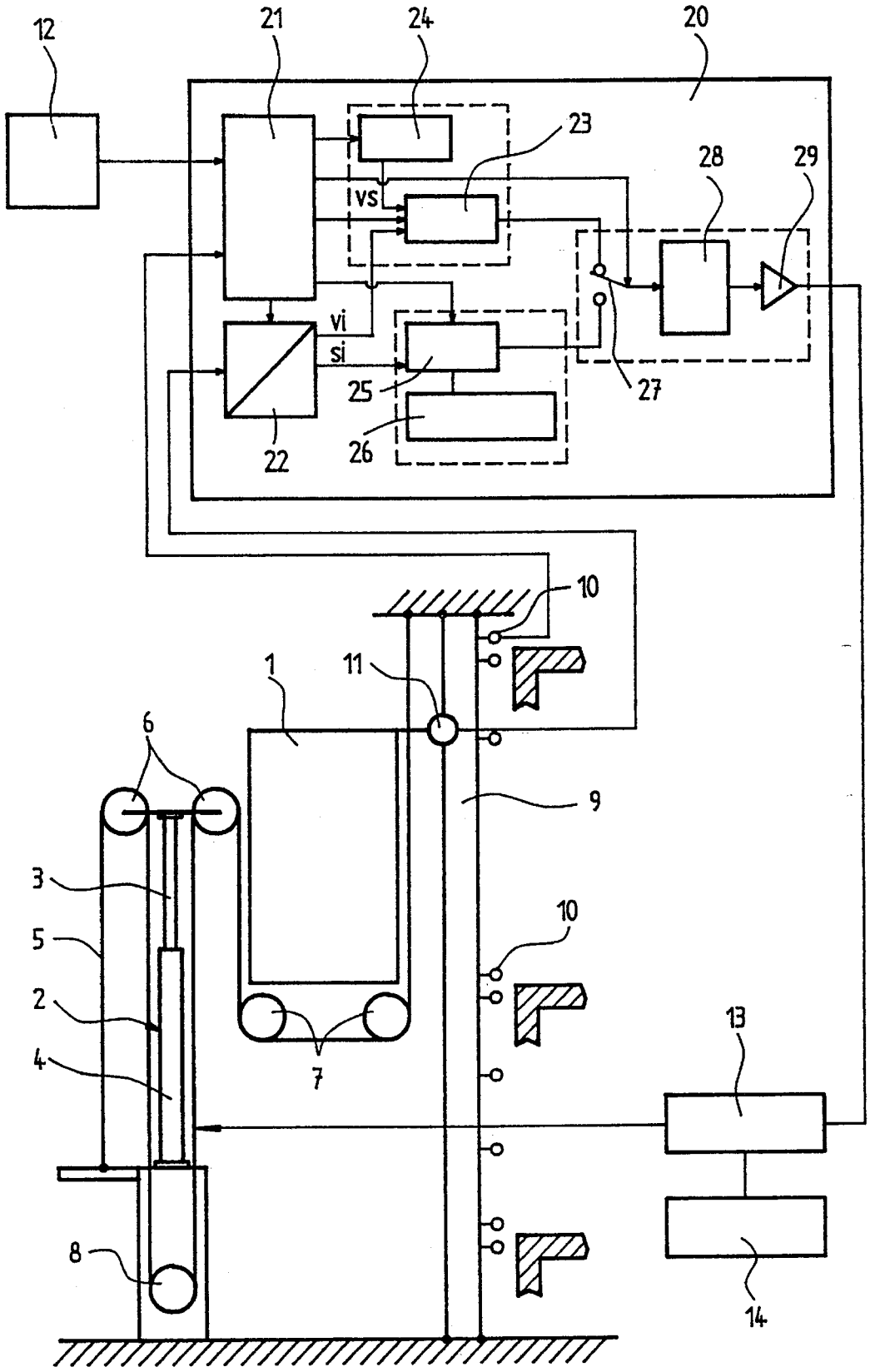
FIG. 1 is a schematic representation of the apparatus of this invention.

In FIG. 1, numeral 1 designates an elevator car which can be set into motion with a hydraulic lifting apparatus having a piston 3 and a cylinder 4. This motion is transferred by means of a cable 5 that runs over two rolls 6, secured on piston 3; two rolls 7, secured on cabin 1 and a fixedly secured roll 8, with car 1 being guided in elevator shaft 9. A shaft switch 10, secured in shaft 9, a sensing element 11 connected with car 1; and a lift controller or operating control 12 are all operatively interconnected with a preferably digital control device 20. Sensing element 11 includes a wheel that runs along a taut cable extending along the length of the shaft and provides or outputs travel or position signals in the form of pulse signals. Sensing element 11 can function as described or function in other mechanical ways as well as electrically or optically. A regulating valve arrangement 13, to be described more completely hereafter relative to FIG. 2, is electrically interconnected with the output of control device or regulator 20 as well as being connected with hydraulic lift apparatus 2 and a source of fluid pressure, via hydraulic lines or conduits.

Lift controller 12 conducts or channels drive inputs to regulator 20. Brake input signals are channelled to regulator 20 by a regulator control system 21, which in turn forms a portion of regulator 20. The brake signals originate from shaft switches 10 which are arranged at predetermined spacings or distances ahead of the floors or landings. Brake input signals can also be carried by sensing element 11, in that, for example, with a certain number of added or summed position signals, equivalent shaft information is produced. Regulator 20 produces a signal S which is supplied to regulation valve arrangement 13.

Regulator control system 21 is connected with a tachometer signal transformer 22 which transforms the position signals, supplied by shaft switch 11, into actual velocity values vi or actual position values si. A speed regulator 23 is connected, on its input side, with that output side of tachometer signal transformer 22 that outputs the actual velocity values vi and with that output of a speed reference value setting means or set value generator 24 that outputs velocity set values vs with set value generator 24 being connected, on its input side, with regulator control system 21. Speed regulator 23 can, via an additional inlet, connected with regulator control system 21, be reset or started. Speed regulator 23 can take the form of a conventional PID-controller. Numeral 25 designates a position controller which will be described in more detail with reference to FIG. 5, with position controller 25 being connected, on its input side, with that output side of tachometer signal transformer 22 that outputs the actual position value si. Position controller 25 includes a table 26 within which allocations of actual position values si are stored relative to percentage values %S of a control region or domain CS which will be described later with reference to FIG. 4. A switching device 27 is connected with the output of regulator control system 21, the output of speed regulator 23, the output of position controller 25 and the input of a DA converter 28. The outlet of position controller 25 can be switched at the input of DA converter 28 by means of switching device 27 upon the input of shaft information signalling the input or entry of a brake input point. The output of DA converter 28 is connected with an amplifier 29, the output of which also is the output of control device 20.

Figure 2:
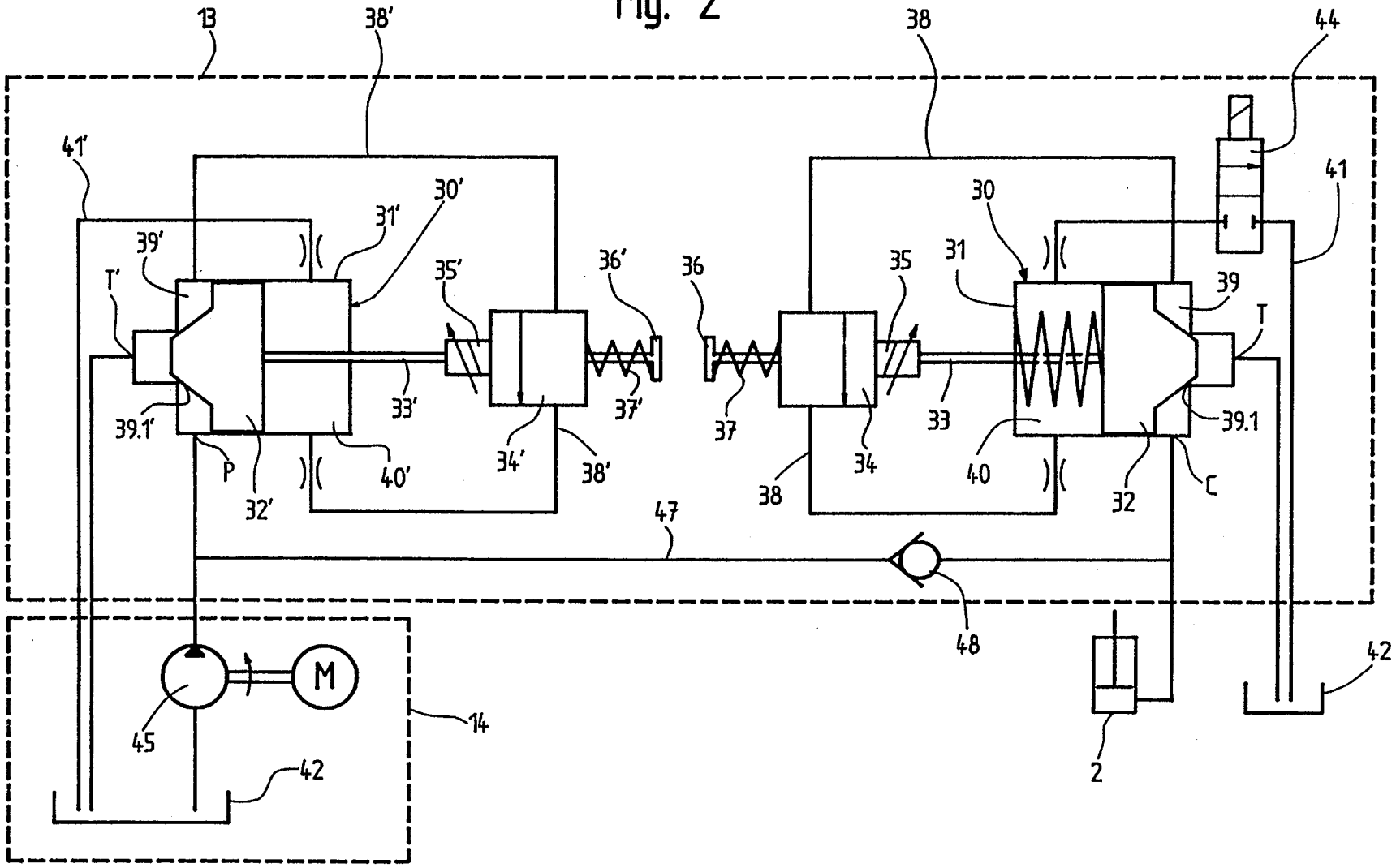
FIG. 2 is a schematic representation of a regulating valve arrangement of the apparatus of to FIG. 1.

The regulation valve arrangement shown in FIG. 2 includes two electro-hydraulic flow control valves 30, 30' of the same type. The following description, pertaining to flow control valve 30, regarding the control of the lowering process, pertains in the same manner to mirror-image flow control valve 30', regarding the control of the lifting of the car, with the same but prime numerals being utilized for valve 30'.

A main valve piston 32 resides within valve chamber 31, with the former having a piston rod 33 extending from its rear portion. Surrounding piston rod 33, but without a functional connection therewith, is a pilot valve 34, including an electromagnet 35, with valve 34 being electrically connected with the output of control device 20 shown in FIG. 1. Piston rod 33 extends from the rear of pilot valve 34 and is equipped with an abutment 36 at its rear, with a compression spring 37 being interposed between abutment 36 and pilot valve 34. Compression spring 37 opposes the force of electromagnet 35. Via the use of compression spring 37, a closed control loop, having an internal feedback within pilot valve 34, is established. Pilot valve 34 is located in connection line or conduit 38 and regulates the through-flow of hydraulic fluid, with conduit 38 interconnecting a front chamber 39 and a rear chamber 40 of valve chamber 31.

Valve front chamber 39 includes an inlet C connected with variable passage or port 39.1 with an outlet T, the latter terminating into tank or reservoir 42. Inlet C is connected with cylinder 4 of lift apparatus 2. Valve rear chamber 40 is also connected with reservoir 42 via drain line 41, with an electromagnetic closing valve 44 being interposed in drain line 41.

Regulation valve arrangement 13 operates via stroke force feedback, that is the force of compression spring 37 which represents the position of mainvalve piston 32, is measured and serves as a feedback or reaction signal. This achieves that the force of electromagnet 35, that is the force of control signal S, is proportional to the position or location of main valve piston 32. This solution exhibits good dynamic behavior, is inexpensive as well as being of simple construction. Of course other, for example hydraulic, electric or mechanical feed back systems could also be utilized.

In fluid control valve 30', outlet T' of valve front chamber 39' is also connected with reservoir 42. An inlet, designated as P, is operatively connected with a motor-driven pump 45 of fluid pressure source 14, with pump 45 having its suction inlet within reservoir 42. Flow control valve 30' does not require a closing valve in its drain line 41'.

Inlets C and P are interconnected with a connecting conduit 47 having a back flow check valve 48, the latter acting in a manner so that the hydraulic medium of lift apparatus 2 cannot flow back in the direction toward pump 45.

At rest or the non-operation of car 1, signal S is zero and flow control valve 30 is closed by hydraulic pressure. This parameter is achieved when pilot valve 34 is slightly opened so that valve chambers 39 and 40 are interconnected and that the force acting on the large rear surface of main valve piston 32, in rear valve chamber 40, displaces piston 32 in the direction toward front valve chamber 39. Closing valve 44 is closed both in the at-rest position of car 1 as well as during the lift phase thereof, with flow control valve 30' being open during the at-rest position of car 1.

Upon receipt of a call or input requesting descent or a down trip, control device 20 initiates a signal S which corresponds to the closed position of flow control valve 30, that is that pilot valve 34 is opened to the extent that its opening cross section exceeds that of drain line 41. During the subsequent opening of closing valve 44, main valve piston 32 remains in its closed position even during drainage flow of the hydraulic medium via drain line 41. Thereafter, electromagnet 35 receives a proportional signal S', opposite to signal S, which principally causes the following: The force of electromagnet 35 opposes that of compression spring 37. When main valve piston 32, via the pressure differences existing in chambers 39 and 40, is translated to the extent that the through-flow of hydraulic pressure through connecting line 38 is the same as that in drain line 41, the movement of main valve piston 32 stops at that location until control signal S is changed.

Upon an increase in signal S, that is upon a decrease in signal S', this also decreases the opening cross section of pilot valve 34 and main valve piston 32 is then moved, due to the reduction in pressure, back into rear chamber 40. Passage 39.1 is then opened and the pressure medium then flows from lift apparatus 2 into reservoir 42, whereupon car 1 descends. Signal S increases until car 1 achieves the desired maximal speed, with signal S remaining at this level until a brake input signal is received. From this point on, signal S is again reduced, in a position-dependent manner, by control device 20, whereby main valve piston 32 moves in the direction of passage or port 39.1 until it fully closes same so as to bring car 1 to a stop. At this time, closing valve 44 is also closed, with flow control valve 30' remaining open, in an unchanged manner, during the descent of car 1.

Flow control valve 30' for the lifting of car 1, functions principally in the same manner as flow control valve 30, however with the exception that signal S', for electromagnet 35' is proportional to signal S. Upon receipt of a call or input requesting ascent or lift, pump 45 is actuated which then pumps pressurized fluid into reservoir 41 via front chamber 39' and port 39.1'. Thereafter, pilot valve 34' receives a signal S' which causes the opening of connecting line 38'. Thereafter, the pressure medium flows from front chamber 39' to rear chamber 40'. At a specific rate of signal S, the opening cross section of pilot valve 34' becomes greater than that of drain line 41. This causes a pressure rise within rear chamber 40' and main valve piston 32' then moves to the front thus reducing the opening of port 39.1'. As soon as the pressure within chamber 39' exceeds the pressure within lift apparatus 2, back flow check valve 48 opens and car 1 is set in motion. Upon the total closing of port 39.1' the lift ascends at maximum speed.

The acceleration phase as well as the drive at the nominal or operating speed can proceed without regulation. During descent, the totally unthrottled capacity of pump 45 can thus be utilized, with the maximum speed of car 1 thus being determined by the pump capacity. The descent speed can be limited via a correspondingly measured aperture opening in the drain line of lift apparatus 2.

The illustrated operative example utilizes two pilot valve arrangements wherein only one is operative in each direction of travel. A further operative variation utilizes but one pilot valve arrangement for both directions of travel so as to alternately control valves 30, 30'.

Figure 3:
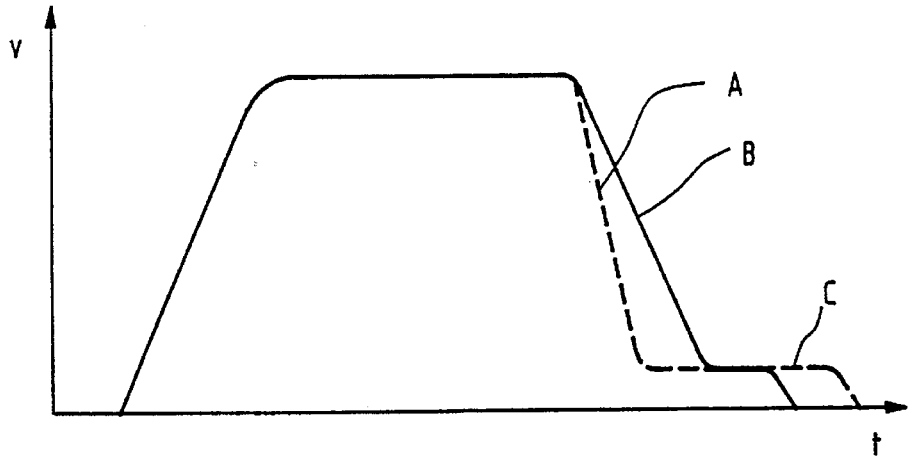
Fig. 3 PRIOR ART
FIG. 3 is a velocity/time diagram of a prior art hydraulic elevator.

In the prior art, as represented in FIG. 3, v represents velocity while t represents time. Depending upon the load and the temperature of the hydraulic medium during the deceleration phase, differing speed/time response curves A, B, are obtained so that for an exact entrance or stop a creeping velocity is required.

Accordingly, in FIG. 4 v and t again represent velocity and time, wherein the velocity axis also corresponds to control signal S produced by control device 20. A response curve D represents the actual velocity progression while a response curve E represents the progression of control signal S at the outlet of control device 20 during a trip of car 1. In addition the following abbreviations are utilized:

SO, S1, S2 are defined values of control signal S;
CS is a control regions;
H is a hysteresis value; and
CO is a control deviation.

Figure 5:
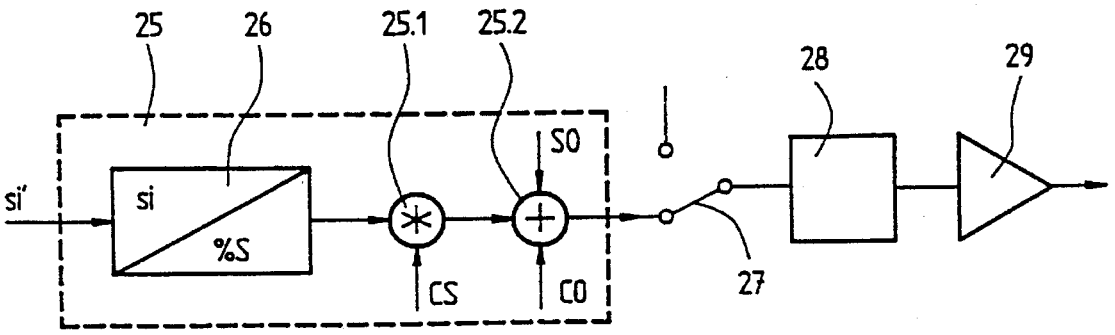
FIG. 5 is a block-diagram illustration of a position controller of the apparatus according to FIG. 1.

As per FIG. 5, table 26 is connected with the input of a multiplier 25.1, with table 26 being the means via which the control signals, corresponding to the actual position values si, for regulation valve arrangements 13, are produced during the deceleration phase. Multiplier 25.1 in turn, in each instance, multiplies a percentage value %S, corresponding to the actual position value si', with the calculated value of control region CS. For the improvement of the control yield, the output of multiplier 25.1 is connected with the input of an adder or accumulator 25.2, the latter adding the control deviation CO and the pilot control signal SO to the product of multiplier 25.1, with the accumulator outlet also taking the form of the outlet of position controller 25.

Figure 4:
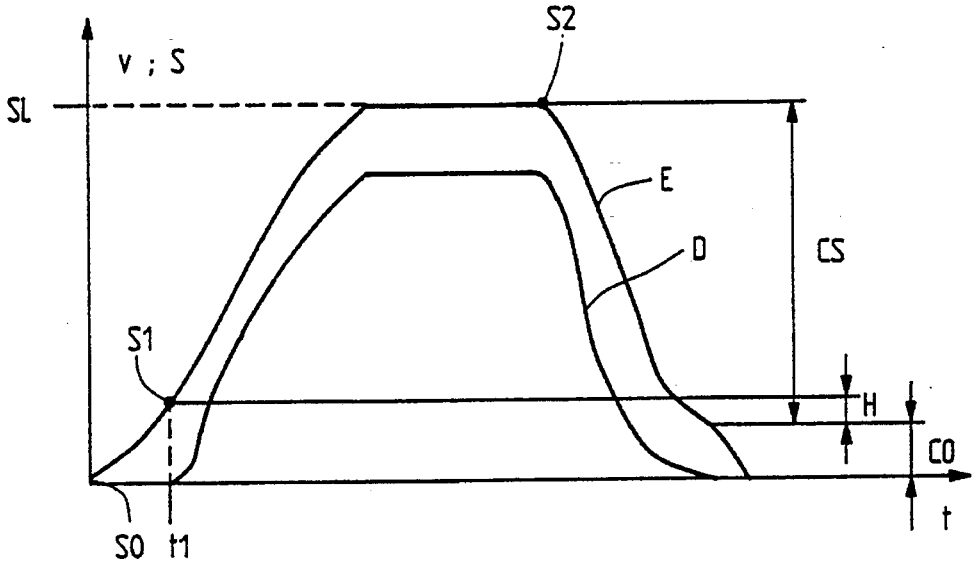
FIG. 4 is a velocity/time diagram and a control signal/time diagram of a hydraulic elevator controlled by the apparatus of this invention.

The previously described control device 20 operates in the following manner: Upon the receipt of a drive input, from lift controller 12, the speed regulator 23 is reset or activated via regulator control system 21 and the input of DA converter 28 is switched, via switching device 27, to the output of speed regulator 23. Car 1, during the acceleration phase and during the trip, is controlled at a constant velocity via the comparison of the actual velocity values vi and the set or desired velocity values vs, whereby the control signal S, at the output of control device 20, takes the form or progression of response curve E in FIG. 4. Upon receipt of drive command, car 1 is set in motion at start time point t1 and, at the same time, a first value S1 of control signal S is accumulated or stored, as shown in FIG. 4. Once car 1 receives a brake input point, the respective shaft switch 10, or sensing element 11, sends a shaft information to regulator control system 21, whereupon the deceleration phase is initiated. Thereupon, position controller 25 is activated and its output 27 is switched to the input of DA converter 28 by means of switching device 27. At the same time period, a second value S2, of control signal S, is stored and a control region CS is calculated according to the relationship CS=S2−S1+H (FIG. 4), wherein S1 and S2 are the first and second values of control signal S and H is a hysteresis value which is ascertained in a manner to be described hereinafter. Position controller 25 now functions in the manner, as already described relative to FIG. 5 the percentage values %S, corresponding to the actual position values si, are multiplied with the calculated value of control region CS and the control deviations CO as well as the pilot control signal so are added thereto, wherein CO=S2−SO−CS, as per FIG. 4. The thus ascertained sum is channelled to amplifier 29 (FIG. 1) via switching device 27 and DA converter 28, with this thus ascertained sum then taking the form of the current actual output signal S at the output of amplifier 29.

As already noted during the description of FIG. 2, at the selected regulation valve arrangement 13, the setting of main valve piston 32 is directly proportional to control signal S. However, control signal S, as produced by speed regulator 23 is load and temperature-dependent up to the time period of the brake input. Since however the control region for the deceleration phase is newly fixed in view of values S1, S2 and H relative to the actual and constant-remaining (during the trip) load and temperature conditions, an exact direct input or approach can be achieved without requiring a level readjustment.

The hysteresis value H is determined, during a learning or self-teaching trip in the following manner: The control signal S is increased until the velocity achieves a predetermined or given value. Upon the attainment of this given value, the strength of control signal S is measured and stored. Thereafter, the signal is increased further and after a while it is again decreased until the given velocity value is again achieved. Then the strength of control signal S is measured again and from the two measured values a difference is derived which constitutes hysteresis value H.

Further lift-specific parameters that are in combination with a direct entry or input, such as for example a pilot control signal SO or a boundary or marginal signal SL can also be determined during a learning or self-teaching trip.

Pilot control signal SO:

Pilot control signal SO achieves, on one hand, an instantaneous descent start of the car after the start command, on the other hand, via the use of pilot control signal SO, the starting jolt can be significantly reduced. For the determination of pilot signal SO, electromagnet 35 of the regulation valve arrangement is impacted with an increasing stepped control signal S until the car moves. The thus determined control signal is reduced by a constant value and stored as a pilot control signal. Upon receipt of a drive command, the regulation valve arrangement 13 is directly impacted or exposed to pilot control signal SO.

Boundary or marginal control signal SL:

The boundary or marginal control signal SL is that specific control signal S, with which main valve piston 32, of regulation valve arrangement 13, achieves its end or rest position. Control device 20 operates in such a fashion that the value of control signal S can never exceed the value of boundary signal SL. As has been previously noted, a hydraulic lift is usually operated in a velocity-controlled manner. With a boundary signal SL, defined during a learning or self-teaching trip, unregulated operation is achievable during a constant trip and position-controlled operation is achievable during the succeeding deceleration phase.

During velocity-controlled operation, a portion of the pressure medium, produced by fluid pressure source 14, is channelled back into reservoir 42 via an overflow conduit. During uncontrolled or non-regulated operation, boundary control signal SL is admitted or added to regulation valve arrangement 13, so that the entire output of fluid pressure source 14 is applied in lift apparatus 2, thus markedly increasing the efficiency thereof. The transition from non-regulated constant drive to position-controlled deceleration drive occurs without control delay, since the value of boundary control signal SL, even during the previous non-regulated operation, is such that main valve piston 32 can immediately follow boundary control signal SL. For the determination of boundary control signal SL, the signal of the regulation valve arrangement is impacted with an increasing stepped control signal S, until the velocity of the lift or car no longer increases. The thus determined control signal is stored by control device 20 as boundary control signal SL.

The device of this invention is preferably operated via a microcomputer system.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A process for controlling a hydraulic lift including a control device and control signals produced by a sensing element associated with a car of the lift, the control signals are forwarded to a regulation valve arrangement for regulating a through-flow of pressurized fluid to accelerate, upwardly or downwardly, the lift car, the lift car is moved at an operational speed and decelerated upon receiving a slow down signal input from elevator shaft information, the process comprising:

receiving lift car position signals from the sensing element and controlling a position of the car during a deceleration phase occurring after the slow down signal is input;

issuing a drive command;

determining and storing a first value of the control signal at the start time the drive command is issued;

storing a second value of the control signal upon receiving the slow down signal;

calculating a control region based on the following relationship:

$$CS=S2-S1+H,$$

wherein, CS represents the control region; S1 represents the first value of the control signal; S2 represents the second value of the control signal; and H represents a previously determined hysteresis value;

producing, during the deceleration phase, actual position values from the lift car position signals;

ascertaining a percentage value of the control region for each actual position value;

multiplying each ascertained percentage value with the calculated value of the control region; and determining an extent of the control signal utilized during the deceleration phase.

2. The process of claim 1, wherein a signal, reproducing the location of a main valve piston, obtained via a spring coupled to a piston rod, serves as a feedback signal.

3. The process of claim 1, further including: adding to a product designated as the control signal, a control deviation (CO) and a pilot control signal (SO), wherein CO is determined via the relationship CO=S2–SO–CS, and wherein S2 is the second value of the control signal, SO is the pilot control signal and CS is the control region, with the thus ascertained sum representing the control signal, that is utilized during the deceleration phase.

4. The process of claim 1 further including: determining a hysteresis value during a learning trip, whereby the control signal is increased until the velocity achieves a predetermined value, wherein, upon reaching the predetermined value, measuring and storing the strength of the control signal, thereafter increasing the control signal and after a while again decreasing the control signal, until again reaching the predetermined value of the velocity, again measuring the strength if the control signal, with the difference between the two measured values being the hysteresis value.

5. The process of claim 3 further including: determining a hysteresis value during a learning trip, whereby the control signal is increased until the velocity achieves a predetermined value, wherein, upon reaching the predetermined value, measuring and storing strength of the control signal, thereafter increasing the control signal and after a while again decreasing the control signal, until again reaching the predetermined value of the velocity, again measuring the strength of the control signal, with the difference between the two measured values being the hysteresis value.

6. The process of claim 3, further including: determining the pilot control signal (SO) during a learning trip, wherein a spool of the regulation valve arrangement is impacted with an increasing stepped control signal until the car moves and wherein the thus obtained control signal is reduced by a constant value and stored as a pilot control signal (SO).

7. The process of claim 1 further including: determining a boundary control signal during a learning trip, whereby a spool of the regulation valve arrangement is impacted with an increasing, stepped control signal until the velocity of the car no longer increases.

8. The process as in any one of claims 1 to 6, further including: the car proceeding in an unregulated manner in the phase before the deceleration phase whereby the velocity, in the ascending direction, is limited by the configuration of at least one of the hydraulic components of the hydraulic lift.

9. An apparatus for controlling a hydraulic lift comprising:

a control device controlling a regulation valve arrangement;

a sensing element in combination with a lift car;

said control device including a tachometer signal transducer;

said sensing element is connected to an input of said tachometer signal transducer;

said control device further including a position controller having an input connected with an output of said tachometer signal transducer for receiving actual position values, and having an output connected with the regulation valve arrangement, during a deceleration phase;

said position controller including a table associating actual position values with percentage values of a control region and a multiplier having a first and a second input, said first input of said multiplier being connected with table, said second of said multiplier provided with a value of said control region, and an output of said multiplier forming an output of said position controller.

10. The apparatus of claim 9, wherein the regulation valve arrangement includes a stroke-force feedback.

11. The apparatus of claim 10, wherein the stroke-force feedback is produced via a compression spring.

12. The apparatus of claim 9, wherein the control device utilizes a digital position controller.

* * * * *